US005623901A

United States Patent [19]

Hartzell

[11] Patent Number: 5,623,901

[45] Date of Patent: Apr. 29, 1997

[54] TIME TWISTER CYLINDER HEAD FOR USE IN INTERNAL COMBUSTION ENGINES

[76] Inventor: Mark E. Hartzell, 14687 Brewster Dr., Largo, Fla. 33774

[21] Appl. No.: 696,678

[22] Filed: Aug. 14, 1996

[51] Int. Cl.[6] ..... F01L 5/04

[52] U.S. Cl. ..... 123/190.2; 123/190.14; 123/80 BA; 123/80 D

[58] Field of Search ..... 123/190.1, 190.2, 123/80 R, 80 BA, 80 D, 190.14

[56] References Cited

U.S. PATENT DOCUMENTS

| | | | |
|---|---|---|---|
| 1,079,741 | 11/1913 | Calkins . | |
| 1,215,746 | 2/1917 | Tower . | |
| 1,388,758 | 8/1921 | Rahmeyer . | |
| 1,572,085 | 2/1926 | Risden . | |
| 1,734,076 | 11/1929 | Clementson et al. . | |
| 4,134,381 | 1/1979 | Little . | |
| 4,494,500 | 1/1985 | Hansen . | |
| 4,553,385 | 11/1985 | Lamont . | |
| 4,751,900 | 6/1988 | Ruffolo . | |
| 4,944,262 | 7/1990 | Molina et al. | 123/80 R |
| 4,953,527 | 9/1990 | Coates | 123/80 D |
| 4,989,526 | 2/1991 | Coates | 123/80 D |
| 5,095,870 | 3/1992 | Place et al. . | |
| 5,109,814 | 5/1992 | Coates | 123/80 D |
| 5,255,645 | 10/1993 | Templeton . | |
| 5,437,252 | 8/1995 | Glover | 123/190.2 |

FOREIGN PATENT DOCUMENTS 3253709 11/1991 Japan .

*Primary Examiner*—Erick R. Solis

*Attorney, Agent, or Firm*—Larson & Larson P.A.; James E. Larson

[57] ABSTRACT

A time twister cylinder head includes two rotary valves driven by a timing belt coupled to the engine crankshaft by belts and pulleys to describe a desired rate of rotation of the valves with respect to rotation of the crankshaft. Each valve is generally cylindrical with side faces opening in opposite directions to permit coupling with the intake and exhaust manifolds. The common axis of rotation of the valves is slightly offset from the centerline of the air passages so that pressure buildup in the cylinder will be applied off-center on the valves to enhance rotation.

11 Claims, 7 Drawing Sheets

TIME TWISTER CYLINDER HEAD FOR USE IN INTERNAL COMBUSTION ENGINES

BACKGROUND OF THE INVENTION

The present invention relates to a time twister cylinder head for use in internal combustion engines. In particular, the present invention contemplates the use of rotary intake and exhaust valves coupled to an engine crankshaft through the use of pulleys and belts to prescribe a determined ratio between the rate of rotation of the crankshaft and the rate of rotation of the valves.

In the prior art, the use of rotary valves to control supply and exhaust to and from an engine cylinder, respectively, is known. The following prior art is known to Applicant:

U.S. Pat. No. 1,079,741 to Calkins et al.

U.S. Pat. No. 1,215,746 to Tower

U.S. Pat. No. 1,388,758 to Rahmeyer

U.S. Pat. No. 1,572,085 to Risden

U.S. Pat. No. 1,734,076 to Clementson et al.

U.S. Pat. No. 4,134,381 to Little

U.S. Pat. No. 4,494,500 to Hansen

U.S. Pat. No. 4,553,385 to Lamont

U.S. Pat. No. 4,751,900 to Ruffolo

U.S. Pat. No. 5,095,870 to Place et al.

U.S. Pat. No. 5,255,645 to Templeton.

None of these references is believed to fairly teach or suggest the teachings of the present invention, particularly, the concept of two rotary valves, each of which is in the form of a shallow cylinder having side openings facing in opposed directions and with the drive means therefor being disposed therebetween.

SUMMARY OF THE INVENTION

The present invention relates to a time twister cylinder head for use in internal combustion engines. The present invention includes the following interrelated objects, aspects and features:

(1) In a first aspect, the present invention is contemplated for use in an internal combustion engine. While the example shown herein depicts a four stroke engine, once the present invention is clearly understood with reference to the subsequent specific description of the preferred embodiment and the appended drawing figures, one skilled in the art can adapt the teachings of the present invention to a two stroke internal combustion engine.

(2) In the example shown, the engine includes a cylinder within which a piston reciprocates up and down to drive a crankshaft. Above the cylinder, a cylinder head is disposed carrying cooling passageways as well as intake and exhaust manifolds leading to intake and exhaust passageways, respectively, within the cylinder head.

(3) The intake and exhaust passageways within the cylinder head are open in spaced relation to one another and facing one another. Within the cylinder head, rotary intake and exhaust valves are provided. Each valve consists of a shallow cylinder having a side opening as well as at least one opening or port in the periphery thereof. In the case of the intake valve, the side opening allows an air-fuel mixture to be admitted therein and the peripheral port(s) or opening(s) allow(s) this mixture to be admitted into the cylinder at a desired timing moment. In the case of the exhaust valve, the peripheral opening(s) or port(s) allow(s) exhaust of spent gases from the cylinder and the side opening conveys these gases to the exhaust manifold for discharge.

(4) The drive mechanism for driving the intake and exhaust valves simultaneously is disposed therebetween in the form of a timing pulley mounted between the closed facing side walls of the valves and coupled to each valve so that the pulley and the valves rotate as a unit. A timing belt is coupled to the timing pulley between the valves and is coupled via additional pulleys and shafts to the engine crankshaft. The timing pulleys are sized and configured to provide a desired rate of rotation of the valves with respect to the rate of rotation of the crankshaft.

(5) In the preferred embodiment, the common axis of rotation of the valves is slightly offset from the centerline of the respective air passages so that buildup of pressure in the cylinder will be applied off-center on the intake and exhaust valves to enhance rotation of the valves. In a further aspect, location of the drive mechanism for the valves therebetween enhances the balancing of force application to the valves and reduces the possibility that the valves will bind up within the cylinder head. Additionally, for this purpose, ball bearing sets are preferably disposed to each outside face of the drive pulley between the valves, which bearings engage recesses in the cylinder head to allow smooth operation.

As such, it is a first object of the present invention to provide a time twister cylinder head for use in internal combustion engines.

It is a further object of the present invention to provide such a device including the use of rotary intake and exhaust valves.

It is a yet further object of the present invention to provide such a device wherein the drive means for the valves is disposed therebetween.

It is a still further object of the present invention to provide such a device wherein each valve includes an open side wall and peripheral openings to allow supply and exhaust to and from the cylinder.

It is a yet further object of the present invention to provide such a device wherein the common axis of the valves is slightly offset from the centerline of the air passage to allow exhaust gases to enhance rotation of the valves.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
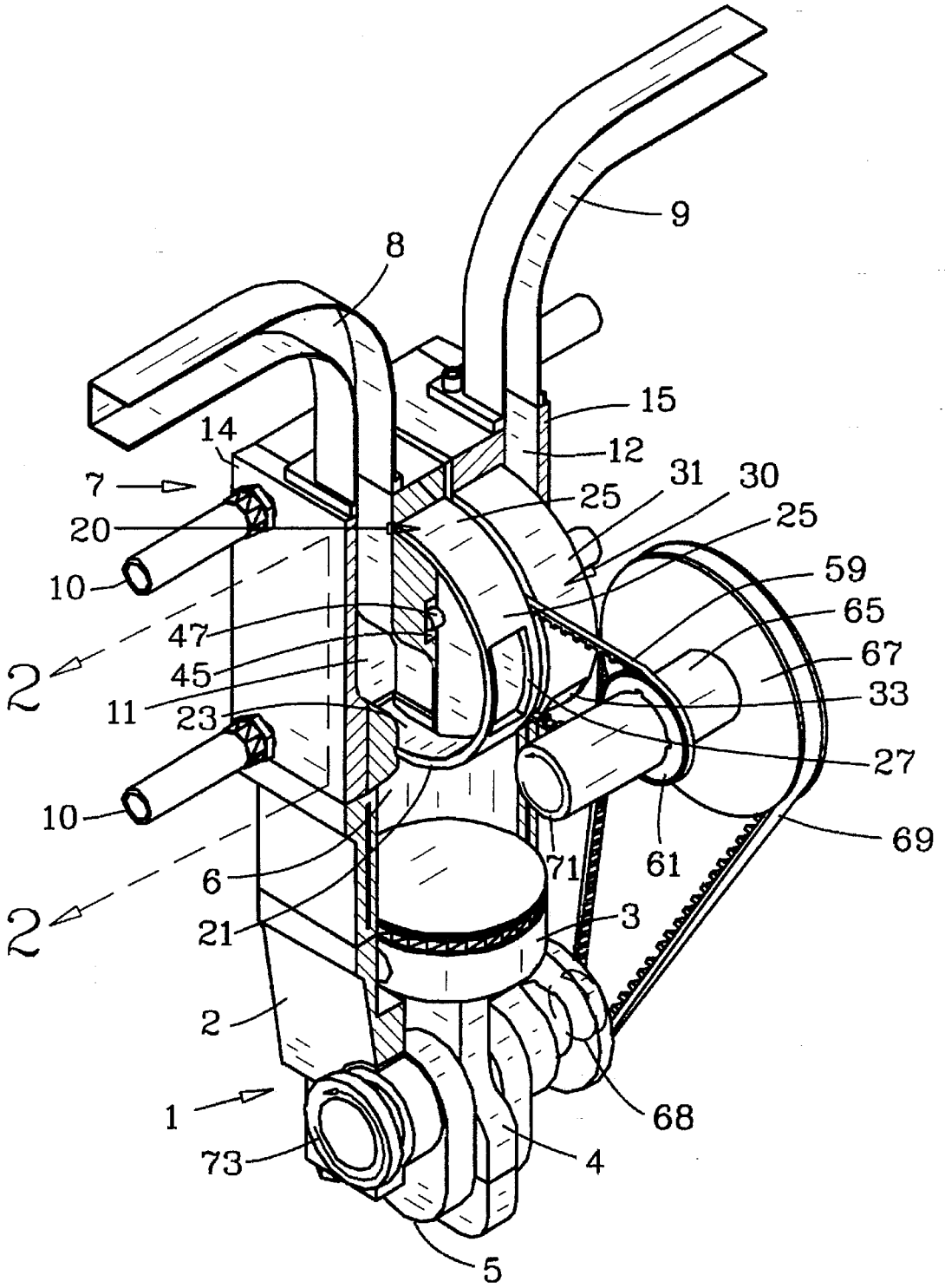
FIG. 1 shows a perspective view, partially in cross-section, of one cylinder-piston-valve assembly of an internal combustion engine in accordance with the teachings of the present invention.

With reference, first, to FIG. 1, a single cylinder-piston-cylinder head assembly in accordance with the teachings of the present invention is generally designated by the reference numeral 1 and is seen to include a piston 3 having a piston connecting rod 4 coupled to the crankshaft 5 in a manner well known to those skilled in the art. The engine block 2 has a cylinder 6 within which the piston 3 reciprocates. A cylinder head 7 defines the uppermost extent of the cylinder 6 and has mounted thereto an intake manifold 8 and an exhaust manifold 9. Cooling passageways 10 extend through the cylinder head in a manner well known to those skilled in the art to keep the engine within desired temperature parameters.

Within the cylinder head 7, an intake passageway 11 communicates with the intake manifold 8 and an exhaust passageway 12 communicates with the exhaust manifold 9.

With further reference to FIG. 1, a rotary intake valve is generally designated by the reference numeral 20 and is seen to include an outside peripheral wall 21 defining a generally circular side opening 23 that is always exposed to the intake passageway 11 and thus to the intake manifold 8. The circular periphery of the valve 20 is designated by the reference numeral 25, and in the embodiment shown in FIG. 1, a single rectangular port 27 is shown as formed by straight side and end walls. When the valve 20 is rotated to a position wherein the port 27 is aligned with the top of the cylinder 6, an air-fuel mixture from the intake manifold 8 is admitted to the cylinder 6. As should be understood, thereafter, as rotation of the valve 20 disconnects the port 27 from the cylinder 6, combustion and a subsequent power stroke takes place.

Figure 2:
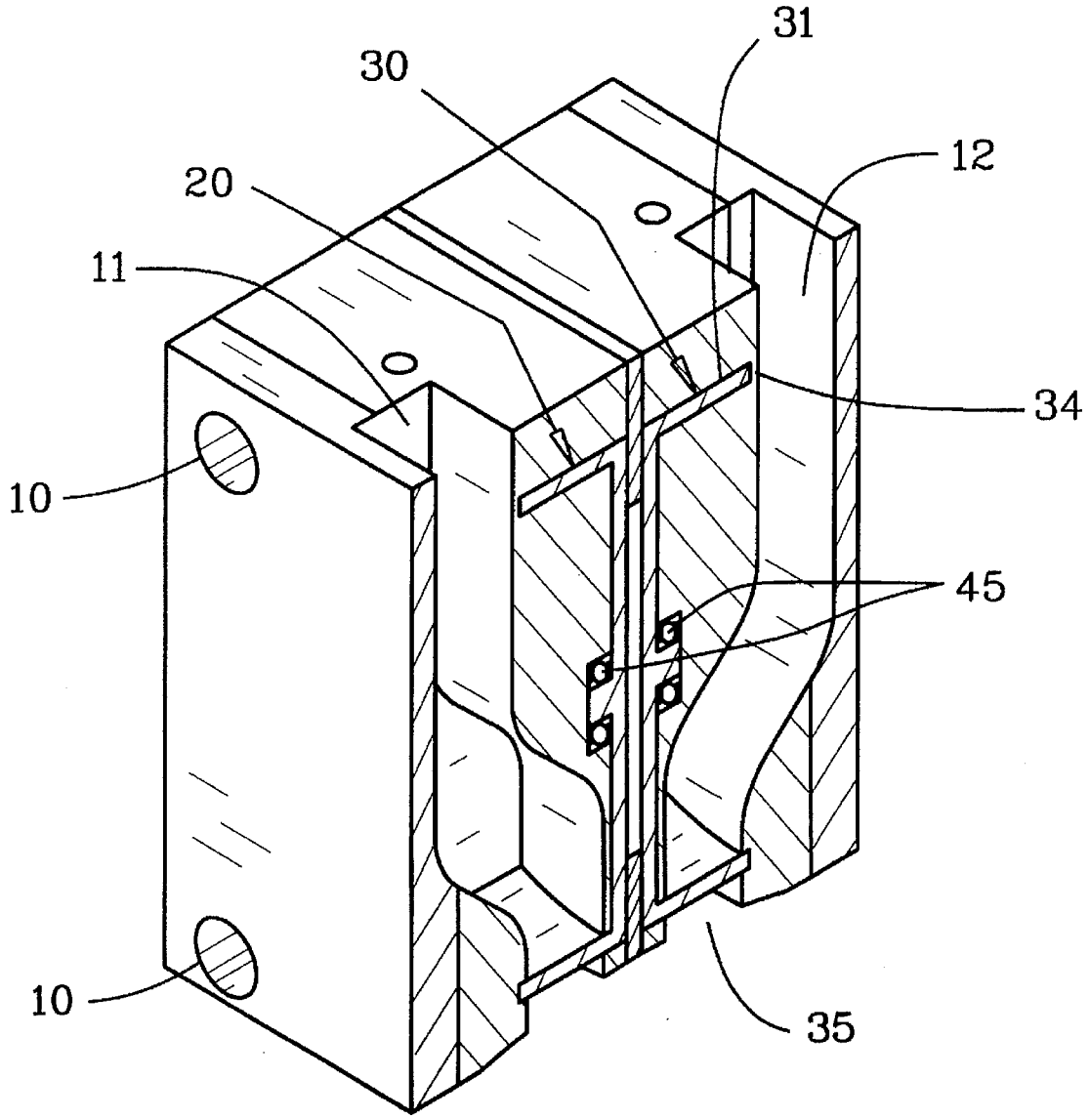
FIG. 2 shows a cross-sectional view along the line 2—2 of FIG. 1.

FIG. 1 also shows an exhaust valve 30 having a periphery 31 within which an exhaust port 33 is provided. As seen in FIG. 2, the exhaust valve 30 has a peripheral wall 34 corresponding to the peripheral wall 21 of the valve 20 defining a generally circular side opening that is always in communication with the exhaust passageway 12 and the exhaust manifold 9. The cylinder head 7 also includes cover plates 14 and 15. When the port 33 is aligned with the cylinder 6, as is arranged by the timing of the inventive device as will be described in greater detail hereinafter, exhaust gases from the cylinder 6 enters the valve chamber 35 and is conveyed to the exhaust manifold 9.

Figure 3:
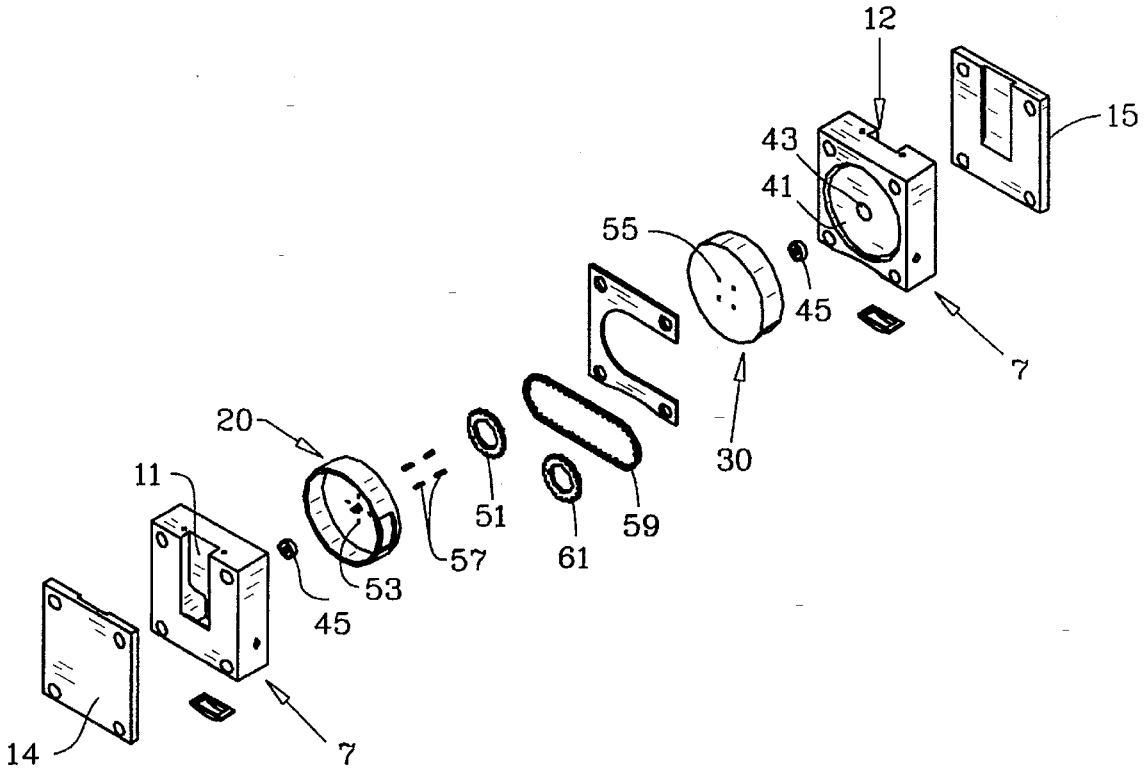
FIG. 3 shows an exploded perspective view of the various components of the cylinder head in accordance with the teachings of the present invention.

As shown in FIG. 3, the cylinder head 7 has two main portions to either side of the valves 20 and 30. As seen in FIG. 3, particularly with reference to the right-hand cylinder head half 7, a generally cylindrical recess 41 is provided in each cylinder head half to receive a respective valve 20 or 30. Within the recess 41, a further centrally disposed recess 43 is provided receiving a roller bearing assembly 45 having a fixed periphery firmly mounted within the recess 43 and a central bearing portion that is coupled to a central shaft 47 (FIGS. 4 and 5) disposed within each valve 20 or 30.

With reference, now, to FIG. 3, it is seen that a timing pulley 51 is disposed between the valves 20 and 30 and is coupled therebetween by virtue of holes 53 formed in the valve 20, holes 55 disposed in the valve 30, aligned holes (not shown) formed in the timing pulley 51 and dowel pins 57 that extend through the holes 53, through the holes in the pulley 51 and through the holes 55 to couple these three components 20, 51 and 30 into a single subassembly. The timing belt 59 is coupled about the periphery of the pulley 51 and is also coupled to an additional timing pulley 61 also seen in FIG. 1.

With reference back to FIG. 1, it is seen that the timing pulley 61 is mounted on a transfer shaft 65 that has mounted thereto a further timing pulley 67 coupled to the crankshaft 5 by an additional timing belt 69 and the pulley 68 shown in phantom in FIG. 1. In the preferred embodiment, the timing pulleys 51 and 61 are of equal size thus defining a one-to-one ratio between the speed of rotation of the shaft 65 and the speed of rotation of the valves 20 and 30. The ratio between the circumference of the pulley 67 and the pulley (not shown) mounted on the crankshaft 5 determines the ratio between the rotative speed of the crankshaft 5 and the valves 20, 30. As seen in FIG. 1, the valves 20, 30 rotate in the direction depicted by the symbol 71, while the crankshaft 5 rotates in the direction of the symbol 73.

Figure 4:
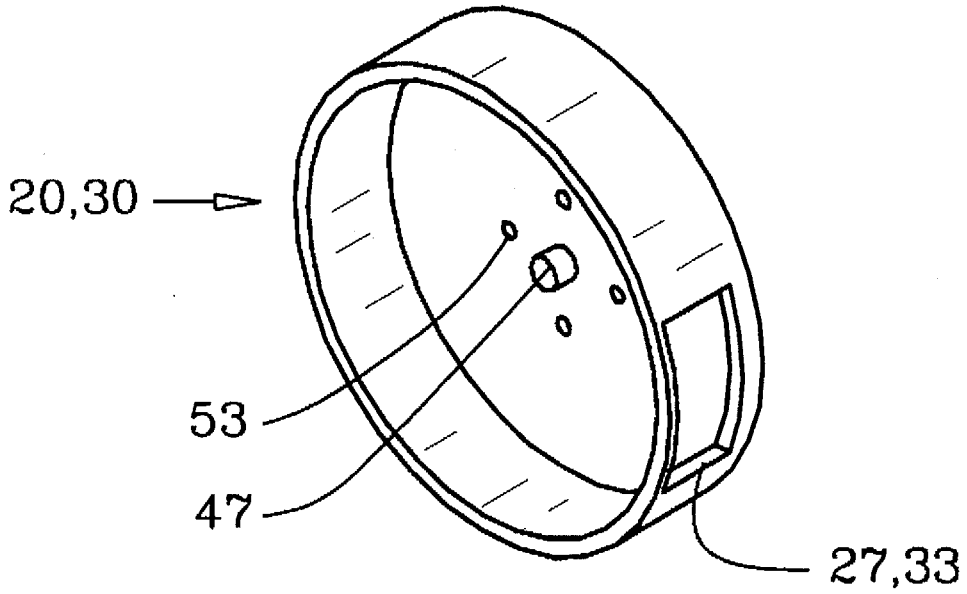
FIG. 4 shows a perspective view of a first embodiment of intake or exhaust valve in accordance with the teachings of the present invention.
Figure 5:
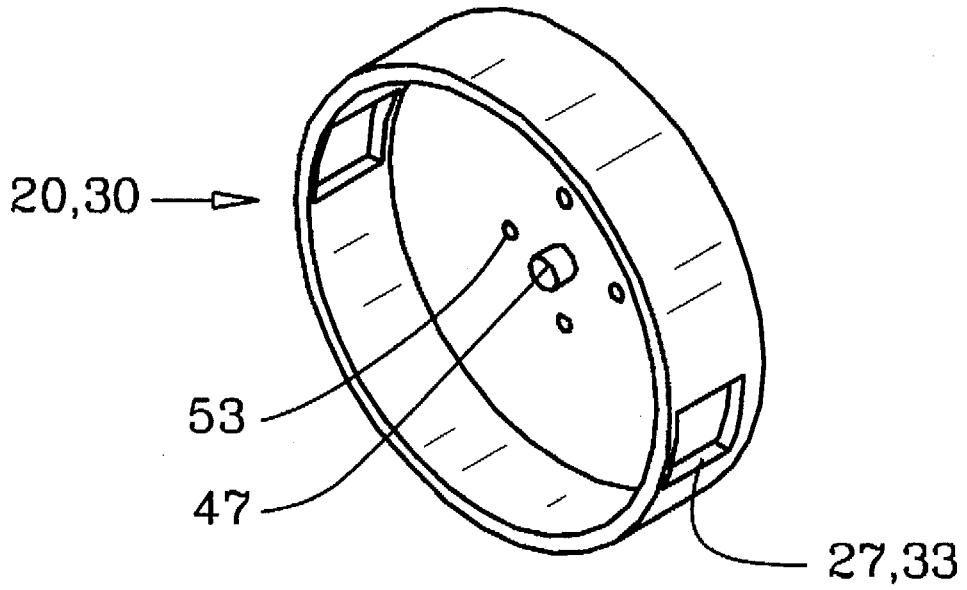
FIG. 5 shows a second embodiment of intake or exhaust valve in accordance with the teachings of the present invention.

FIG. 4 shows a perspective view of either the intake valve 20 or the exhaust valve 30. In each case, there is a single peripheral port 27 or 33. FIG. 5 shows an alternative construction of the intake or exhaust valves 20', 30' wherein two ports 27', 33' are disposed diametrically opposed to one another. In the embodiment of valves shown in FIG. 5, the pulley 65 as shown in FIG. 1 would be adjusted to have twice the circumference as shown in FIG. 1 so that the valves 20', 30' rotate half as fast as the valves 20 and 30 since a port 27', 33' would wipe across the top of the cylinder twice every revolution of the valve 20', 30'.

Figure 6:
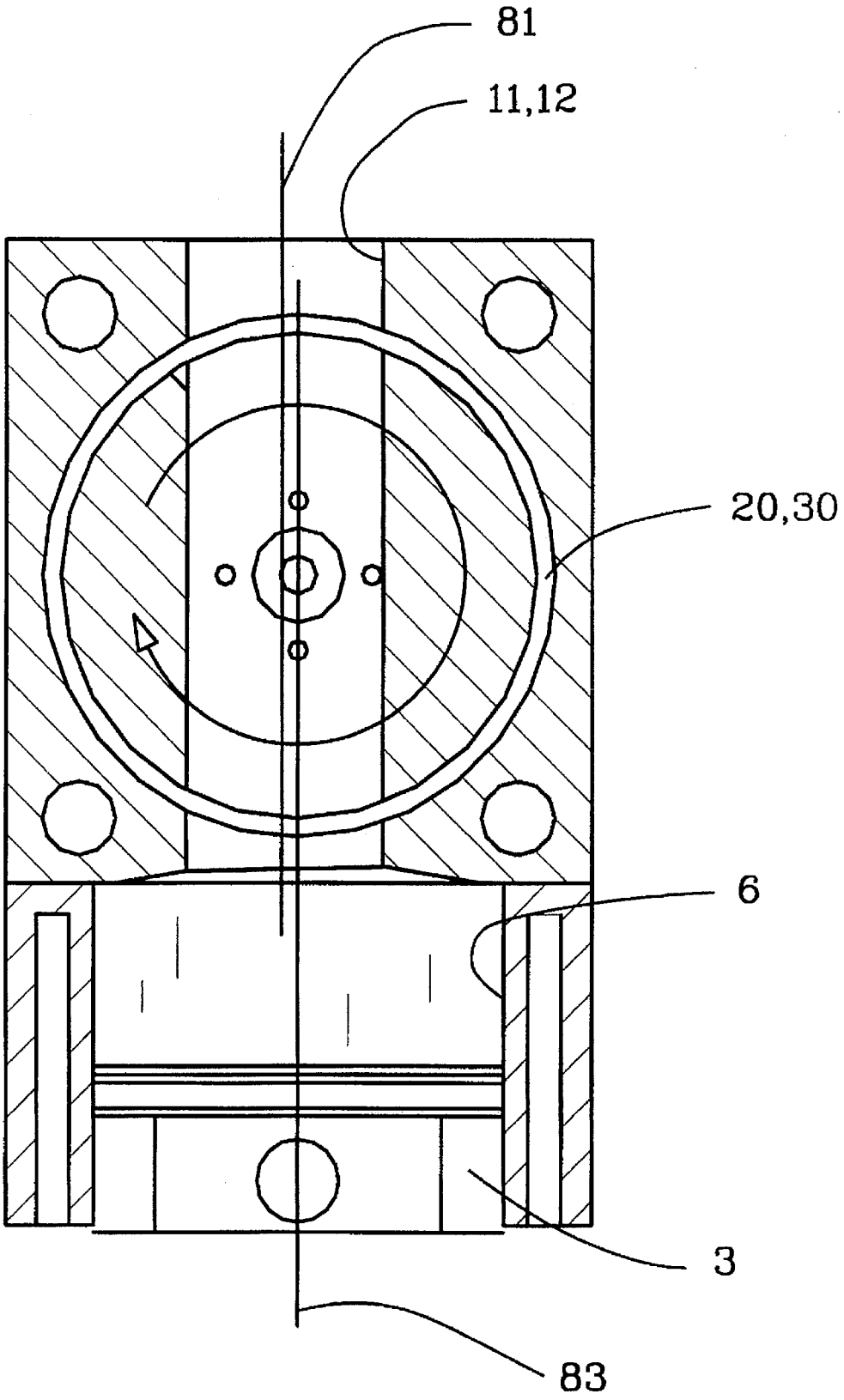
FIG. 6 shows a side view, partially in cross-section, of a piston-cylinder-cylinder head assembly showing the relationship between the centerline of the valves and the centerline of the air passageways.

FIG. 6 shows a side view, partially in cross-section, of the cylinder assembly showing the centerline 81 common to the passageways 11 and 12 as well as the centerline 83 about which the valves 20, 30 rotate. As seen in FIG. 6, these respective centerlines are slightly offset from one another. This offset is provided so that pressure buildup within the cylinder 6 will be applied within the exhaust valve 30 when the port 33 is aligned with the top of the cylinder, off-center on the rotary valve so that the force applied on the exhaust valve enhances rotation of both valves about the bearings 45. This offset causes transfer of all of the impact and force from the bearings to the valve heads themselves. In other words, if the offset were not provided, each time the port 33 wiped across the upper opening of the cylinder 6, the exhaust gas would impinge upon the opposed inner wall of the internal valve chamber thereby increasing wear on the bearings. By slightly offsetting the centerline of the air passage with respect to the centerline of the rotating valve, the exhaust gas engages the internal chamber of the exhaust valve 30 off-center to thereby provide a rotary impetus thereto thereby providing rotary torque and extending bearing life.

Figure 7:
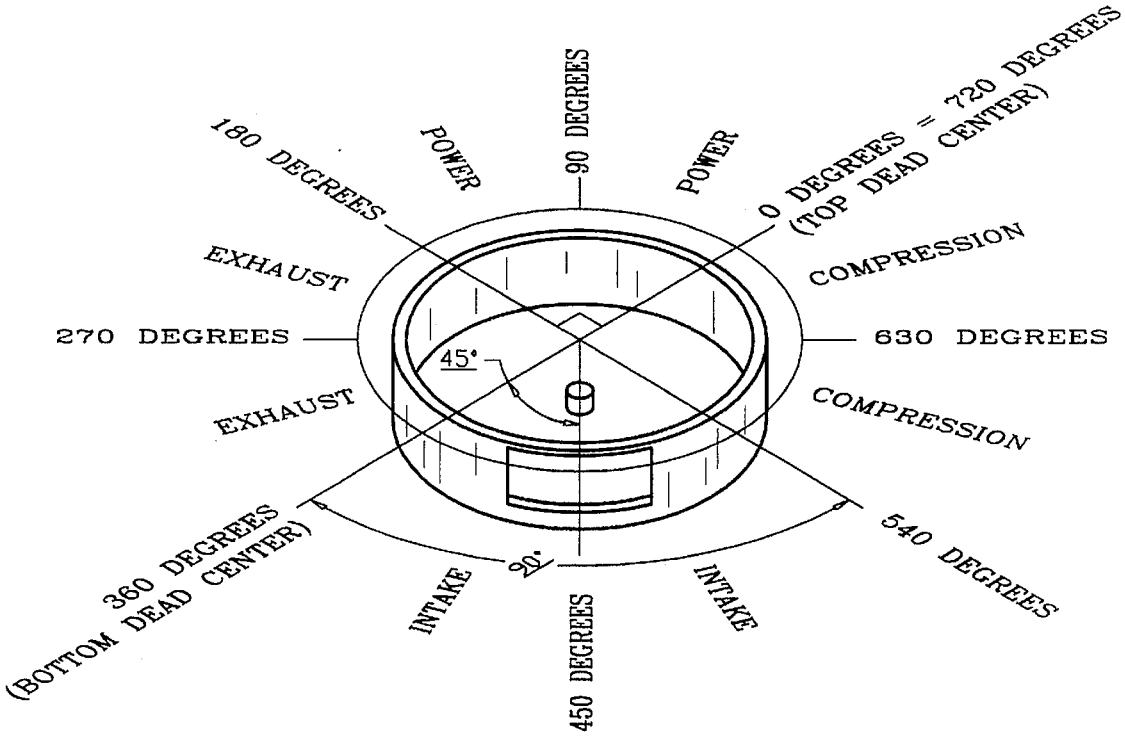
FIG. 7 shows a perspective view of the valve of FIG. 4 with the sequence of operation of the associated engine depicted thereon.
Figure 8:
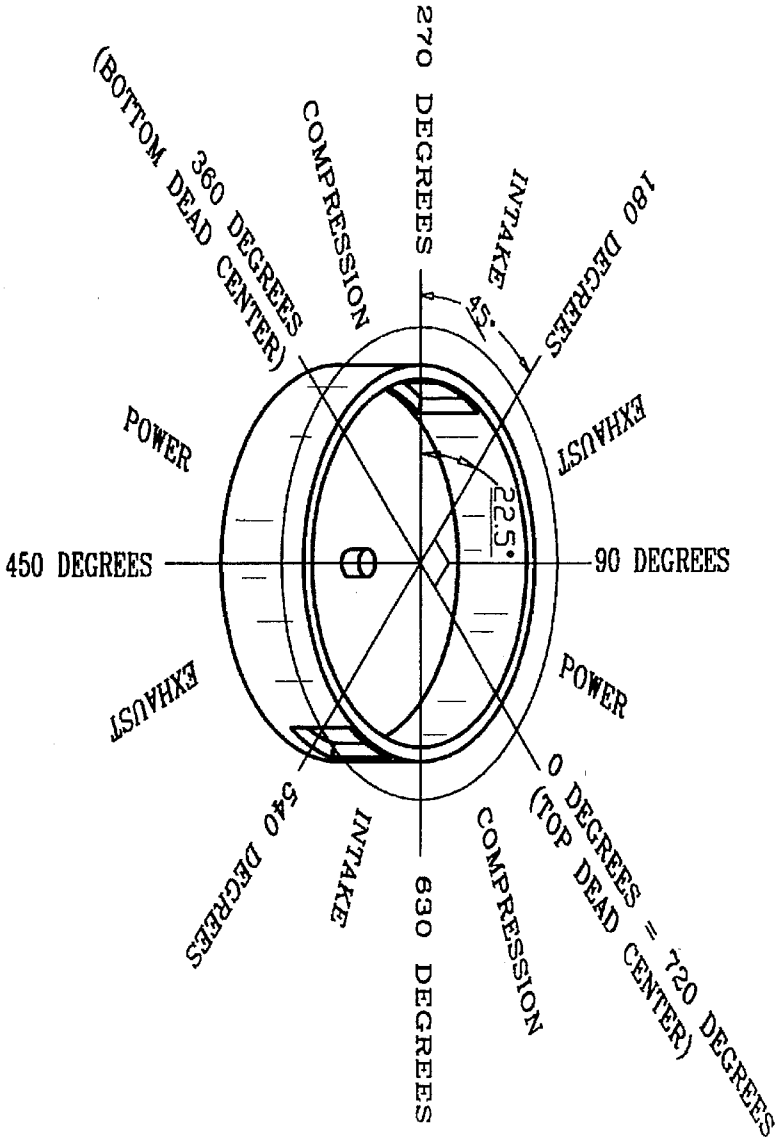
FIG. 8 shows a perspective view of the valve of FIG. 5 with the sequence of operation of the associated engine depicted thereon.

FIG. 7 shows the timing diagram for operation of the associated engine where a valve such as depicted in FIG. 4 with a single port 27 (for the valve 20) or 33 (for the exhaust valve 30) is employed. FIG. 8 shows a timing diagram for operation of the associated engine where the valves 20, 30 are provided with two ports 27' (the valve 20') or 33' (the exhaust valve 30'). In the preferred embodiment, each port defines 45° of arc about the circular periphery of each valve.

Location of the timing belt 59 between the valves 20, 30 also extends the life of the bearings 45 since force application to the valves 20, 30 is therebetween and virtually directly surrounding the bearings 45 by virtue of the close adjacency of the pulley 51.

As such, an invention has been disclosed in terms of a preferred embodiment thereof which fulfills each and every one of the objects of the invention as set forth hereinabove and provides a new and useful time shaft cylinder head for use in internal combustion engines of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. In an internal combustion engine having at least one cylinder within which a piston reciprocates, a crankshaft rotated by reciprocation of said piston, said cylinder having an upwardly facing opening covered by a cylinder head, an intake manifold and an exhaust manifold connected to respective intake and exhaust passageways in said cylinder head, the improvement comprising intake and exhaust valves in said cylinder head for controlling supply to and exhaust from said cylinder;

each of said valves comprising a cylindrical body having a generally circular peripheral wall, a side wall and an opening opposite said side wall, said peripheral wall having a port therethrough;

said intake valve having an inlet comprising a said opening and an outlet comprising a said port;

said exhaust valve having an inlet comprising a said port and an outlet comprising a said opening;

said intake and exhaust valves being mounted in said head with said openings facing away from one another; and drive means for rotating said valves disposed between said valves adjacent said side walls thereof.

2. The invention of claim 1, wherein each of said ports is arcuate and is defined by generally straight walls.

3. The invention of claim 2, wherein each valve includes two diametrically opposed ports.

4. The invention of claim 1, wherein each opening is generally circular.

5. The invention of claim 1, wherein each valve is mounted on said cylinder head via a roller bearing mounted in a recess in said cylinder head.

6. The invention of claim 1, wherein said valves are constrained to rotate together about an axis of rotation, said axis of rotation being laterally offset from a centerline of said exhaust passageway.

7. The invention of claim 1, wherein said drive means comprises a first pulley fastened between said valves, a drive belt coupled to said pulley and a second pulley coupled to said drive belt and to said crankshaft.

8. The invention of claim 7, wherein said second pulley is mounted on a shaft having a third pulley coupled thereto, a fourth pulley attached to said crankshaft and a further drive belt coupled between said third and fourth pulleys.

9. The invention of claim 8, wherein said third pulley is larger in diameter than said second pulley.

10. The invention of claim 9, wherein said fourth pulley is smaller in diameter than said second pulley.

11. In an internal combustion engine having at least one cylinder within which a piston reciprocates, a crankshaft rotated by reciprocation of said piston, said cylinder having an upwardly facing opening covered by a cylinder head, an intake manifold and an exhaust manifold connected to respective intake and exhaust passageways in said cylinder head, the improvement comprising intake and exhaust valves in said cylinder head for controlling supply to and exhaust from said cylinder;

each of said valves comprising a cylindrical body having a generally circular peripheral wall, a side wall and an opening opposite said side wall, said peripheral wall having a port therethrough;

said intake valve having an inlet comprising a said opening and an outlet comprising a said port;

said exhaust valve having an inlet comprising a said port and an outlet comprising a said opening;

said valves being mounted in said head with said openings facing away from one another, said valves being constrained to rotate together about an axis of rotation, said axis of rotation being laterally offset from a centerline of said exhaust passageway; and drive means for rotating said valves disposed between said valves adjacent said side walls thereof, said drive means comprising a first pulley fastened between said valves, a drive belt coupled to said pulley and a second pulley coupled to said drive belt and to said crankshaft.

* * * * *